US011499117B2

(12) United States Patent
Garcia et al.

(10) Patent No.: US 11,499,117 B2
(45) Date of Patent: Nov. 15, 2022

(54) LUBRICATING COMPOSITION

(71) Applicant: SHELL OIL COMPANY, Houston, TX (US)

(72) Inventors: Jose Luis Garcia, Hamburg (DE); Seung Min Yeo, Houston, TX (US); Jörg Reher, Hamburg (DE)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 17/259,825

(22) PCT Filed: Jul. 11, 2019

(86) PCT No.: PCT/EP2019/068751

§ 371 (c)(1),
(2) Date: Jan. 12, 2021

(87) PCT Pub. No.: WO2020/011948

PCT Pub. Date: Jan. 16, 2020

(65) Prior Publication Data

US 2021/0269736 A1 Sep. 2, 2021

Related U.S. Application Data

(60) Provisional application No. 62/697,710, filed on Jul. 13, 2018.

(51) Int. Cl.

| | |
|---|---|
| ***C10M 133/12*** | (2006.01) |
| ***C10M 169/04*** | (2006.01) |
| ***C10M 101/02*** | (2006.01) |
| *C10N 20/00* | (2006.01) |
| *C10N 30/00* | (2006.01) |
| *C10N 40/25* | (2006.01) |
| *C10N 20/02* | (2006.01) |
| *C10N 30/10* | (2006.01) |

(52) U.S. Cl.

CPC ..... *C10M 169/04* (2013.01); *C10M 101/02* (2013.01); *C10M 133/12* (2013.01); *C10M 2203/1085* (2013.01); *C10M 2215/26* (2013.01); *C10N 2020/02* (2013.01); *C10N 2020/067* (2020.05); *C10N 2030/10* (2013.01); *C10N 2030/43* (2020.05); *C10N 2030/45* (2020.05); *C10N 2030/52* (2020.05); *C10N 2040/255* (2020.05)

(58) Field of Classification Search

CPC ..... C10N 2020/02; C10N 2020/067; C10N 2040/255; C10N 2030/45; C10N 2030/52; C10N 2030/43; C10N 2030/10; C10M 169/04; C10M 133/12; C10M 101/02; C10M 2203/1085; C10M 2215/26

USPC ..... 508/563

See application file for complete search history.

(56) References Cited

U.S. PATENT DOCUMENTS

| | | | | |
|---|---|---|---|---|
| 6,090,989 | A | 7/2000 | Trewella et al. | |
| 2003/0186821 | A1 | 10/2003 | Owen et al. | |
| 2004/0094453 | A1* | 5/2004 | Lok | C10M 101/02 208/19 |
| 2009/0233821 | A1* | 9/2009 | Rosenbaum | C10M 111/00 508/110 |
| 2010/0004148 | A1 | 1/2010 | Colbourne et al. | |
| 2016/0115418 | A1* | 4/2016 | Ivancic | C10M 159/12 508/551 |

FOREIGN PATENT DOCUMENTS

| | | | |
|---|---|---|---|
| EP | 0668342 | A1 | 8/1995 |
| EP | 0776959 | A2 | 6/1997 |
| EP | 1803799 | A1 | 7/2007 |
| WO | 9721788 | A1 | 6/1997 |
| WO | 9826030 | A1 | 6/1998 |
| WO | 9941332 | A1 | 8/1999 |
| WO | 0008115 | A1 | 2/2000 |
| WO | 0014179 | A1 | 3/2000 |
| WO | 0014183 | A1 | 3/2000 |
| WO | 0014187 | A2 | 3/2000 |

(Continued)

OTHER PUBLICATIONS

International Search Report and Written Opinion received for PCT Patent Application No. PCT/EP2019/068751, dated Sep. 25, 2019, 10 pages.

"Engine Oil Licensing and Certification System", API 1509, 15th Edition, Apr. 2002, 84 pages.

Othmer, "Laminated Wood-based Composites to Mass Transfer", Encyclopedia of Chemical Technology, vol. 14, Third Edition, 1981, pp. 477-526.

Office Action Received for Chinese Application No. 201980046074.X, dated Feb. 25, 2022, 13 Pages(7 Pages of English Translation and 6 Pages of Official Copy).

*Primary Examiner* — Prem C Singh
*Assistant Examiner* — Francis C Campanell
(74) *Attorney, Agent, or Firm* — Shell USA, Inc.

(57) ABSTRACT

A lubricating composition comprising a base oil and one or more additives, wherein the composition has: a sulphated ash content (according to ASTM D 874) of at least 0.4 wt % and at most 1.0 wt. %, by weight of the lubricating composition; a total base number (TBN) value (according to ASTM D 2896) of at least 4.0 mg KOH/g and at most 12 mg KOH/g; a total aromatics content contributed by the base oil in the range from 1 wt % to 30 wt %, by weight of the lubricating composition; and a sulphur content contributed by the base oil of 0.4 wt % or less, by weight of the lubricating composition; and wherein the base oil comprises a blend of (i) a first base oil which is a mineral base oil selected from an API Group I mineral base oil and an API Group II mineral base oil, and mixtures thereof, and (ii) a second base oil selected from an API Group II base oil and an API Group III base oil, preferably wherein the first base oil belongs to a different API group to that of the second base oil.

4 Claims, No Drawings

(56) References Cited

FOREIGN PATENT DOCUMENTS

| | | | |
|---|---|---|---|
| WO | 0014188 | A2 | 3/2000 |
| WO | 0015736 | A2 | 3/2000 |
| WO | 0118156 | A1 | 3/2001 |
| WO | 0157166 | A1 | 8/2001 |
| WO | 2014057641 | A1 | 4/2014 |

* cited by examiner

LUBRICATING COMPOSITION

CROSS REFERENCE TO RELATED APPLICATIONS

This is a national stage application of International Application No. PCT/EP2019/068751, filed 11 Jul. 2019, which claims benefit of priority to U.S. Provisional Application No. 62/697,710, filed 13 Jul. 2018.

FIELD OF THE INVENTION

The present invention relates to a lubricating composition, in particular for use as a gas engine oil.

BACKGROUND OF THE INVENTION

In power generation, gas engines operate continuously near full load conditions, shutting down only for maintenance and/or change of lubricant. As a result, the lubricant in use is exposed to a sustained high temperature and high pressure environment. These operating conditions may cause relatively severe lubricant oxidation and nitration processes, which lead to alkaline reserve (base number) depletion, increased viscosity and reduced cleanliness in critical engine parts, such as the piston assembly, that can lead to increase in fuel and lubricant consumption and ultimately engine reliability issues.

In commercially available low ash gas engine oil products typically sulphated ash values of about 0.5 wt. % and below 1.0 wt % with TBN (Total Base Number) values of at maximum about 9 mg KOH/g are used. Examples of such commercially available products are Mobil Pegasus 605, Mobil Pegasus 705 and Mobil Pegasus 1005, which are available from Exxon Mobil Corporation.

According to the Technical Data Sheets thereof, Mobil Pegasus 605 has a sulphated ash content (according to ASTM D 874) of 0.5 and a TBN value (according to ASTM D 2896) of 7.1, Mobil Pegasus 705 has a sulphated ash content of 0.5 and a TBN value of 5.6, and Mobil Pegasus 1005 has a sulphated ash content of 0.5 and a TBN value of 5.3.

It is an object of the present invention to improve the oxidation stability of lubricating compositions, especially for use in gas engine oils.

It is another object of the present invention to improve cleanliness performance of lubricating compositions for use in a gas engine.

Another object of the present invention is to improve both oxidation stability and cleanliness performance of lubricating compositions, especially for use in a gas engine.

SUMMARY OF THE INVENTION

One or more of the above or other objects can be obtained by the present invention by providing a lubricating composition comprising a base oil and one or more additives, wherein the composition has:

a sulphated ash content (according to ASTM D 874) of at least 0.4 wt % and at most 1.0 wt. %, by weight of the lubricating composition;

a total base number (TBN) value (according to ASTM D 2896) of at least 4.0 mg KOH/g and at most 15 mg KOH/g; preferably from 6.0 mg KOH/g to 12 mg KOH/g; and a total aromatics content contributed by the base oil in the range from 1 wt % to 20 wt %, preferably from 3 wt % to 15 wt %, by weight of the lubricating composition;

a sulphur content contributed by the base oil (as measured according to ASTM D5453) of 0.4 wt % or less, by weight of the lubricating composition;

and wherein the base oil comprises a blend of (i) a first base oil which is a mineral base oil selected from an API Group I mineral base oil and an API Group II mineral base oil, and mixtures thereof, and (ii) a second base oil selected from an API Group II base oil and an API Group III base oil, preferably wherein the first base oil belongs to a different API group to that of the second base oil.

It has now surprisingly been found that the lubricating compositions according to the present invention exhibit improved oxidation stability, base number retention, deposit control and engine cleanliness performance. This results in longer ODIs (oil drain intervals), which is highly desirable in view of less downtime and lower maintenance costs of the gas engine.

DETAILED DESCRIPTION OF THE INVENTION

The sulphated ash content of the lubricating composition according to the present invention is at least 0.4 wt % and at most 1.0 wt %, by weight of the lubricating composition.

In the lubricating compositions of the present invention, the base number value is at least 4 mg KOH/g, preferably at least 4.3 mg KOH/g. more preferably at least 5.0 mg KOH/g. Typically, the base number is below 12.0 mg KOH/g, preferably below 10.0 mg KOH/g.

In the lubricating compositions of the present invention, the total aromatics content contributed by the base oil is in the range from 1 wt % to 20 wt %, preferably in the range from 1 wt % to 15 wt %, by weight of the lubricating composition (as measured according to IP368). Particularly good results in terms of deposit control, engine cleanliness and oxidation stability can be achieved when the total aromatics content contributed by the base oil is in the range from 4 wt % to 13 wt %, by weight of the lubricating composition.

In the lubricating compositions of the present invention, the maximum sulphur content (%) coming from the base oil is 0.4 wt %, preferably 0.3 wt %, more preferably 0.25 wt %, by weight of the lubricating composition (as measured according to ASTM D5453).

Further it is preferred that the composition has a calcium content (according to ASTM D 4951) of at most 0.3 wt. %, by weight of the lubricating composition. Typically the calcium content is above 0.05 wt. %, more preferably above 0.1 wt. %, even more preferably above 0.15 wt. %, by weight of the lubricating composition.

Further it is preferred according to the present invention that the lubricating composition has a P-content (according to DIN 51363 T2) of at most 0.04 wt. %, by weight of the lubricating composition. Typically the P-content is above 0.01 wt. %, by weight of the lubricating composition.

The base oil used in the lubricating composition of the present invention comprises base oil wherein the base oil comprises a blend of (i) a first base oil and (ii) a second base oil.

The first base oil is a mineral base oil selected from an API Group I mineral base oil, an API Group II mineral base oil and mixtures thereof.

The second base oil is selected from an API Group II base oil and an API Group III base oil, and mixtures thereof.

As a preferred feature herein, the first base oil belongs to a different API group to that of the second base oil.

It has been found that particularly good results in terms of deposit control and oxidation stability can be achieved when the first base oil belongs to a different API group to that of the second base oil. Good results in deposit control leads to improved engine cleanliness properties.

Preferably, the first base oil is an API Group I mineral base oil.

Preferably, the second base oil is an API Group II base oil, preferably an API Group II mineral base oil. In one embodiment herein, the first base oil is an API Group I mineral base oil and the second base oil is an API Group II base oil, preferably an API Group II mineral base oil.

In another embodiment herein, the first base oil is an API Group I mineral base oil and the second base oil is an API Group III base oil.

In a further embodiment herein, the first base oil is an API Group II mineral base oil and the second base oil is an API Group III base oil.

In a further embodiment herein, the first base oil is an API Group II mineral base oil and the second base oil is an API Group II base oil, preferably a non-mineral base oil.

While the first base oil must be a mineral base oil, the second base oil need not be a mineral base oil. The second base oil can, for example, be a mineral base oil, or it can be a non-mineral base oil such as a synthetic base oil, and the like.

In one embodiment, the first base oil is a Group I mineral base oil wherein the API Group I mineral base oil is present in the lubricating composition at a level of 40 wt % or less, preferably 30 wt % or less, by weight of the lubricating composition. Preferably the API Group I mineral base oil is present in the lubricating composition at a level of 5 wt % or more. In a preferred embodiment, the API Group I mineral base oil is present at a level of from 10 wt % to 30 wt %, by weight of the lubricating composition. The API Group I mineral base oil can comprise a mixture of different API Group I mineral base oils and the above reference to the level of API Group I mineral base oil is to the total level of API Group I mineral base oil in the lubricating composition.

When the lubricating composition contains a Group II base oil, the total level of Group II base oil is preferably at a level of at least 50 wt %, by weight of the lubricating composition. In one embodiment of the present invention, the first base oil is a Group II base oil. If the first base oil is a Group II base oil, it is preferably present at a level of at least 10 wt %, more preferably at least 40 wt %, and at most 80 wt %, by weight of the lubricating composition.

When the lubricating composition contains a Group III base oil, the total level of Group III base oil is preferably at least 50 wt %, by weight of the lubricating composition.

The API Group II base oil can comprise a mixture of different API Group II base oils and the above reference to the level of API Group II base oil is to the total level of API Group II base oil in the lubricating composition. Similarly, the API Group III base oil can comprise a mixture of different API Group III base oils and the above reference to the level of API Group III base oil is to the total level of API Group III base oil in the lubricating composition.

There is no limitation as to the type of mineral base oils which can be used in the lubricating compositions herein. Various conventional mineral oils may be conveniently used herein. Mineral oils include liquid petroleum oils and solvent-treated or acid-treated mineral lubricating oil of the paraffinic, naphthenic, or mixed paraffinic/naphthenic type which may be further refined by hydrofinishing processes and/or dewaxing.

In a preferred embodiment herein, the API Group I mineral base oil is a brightstock, which is preferably present at a level of 10 wt % or less, by weight of the lubricating composition. The brightstock preferably has a kinematic viscosity at 100° C. of 25 $mm^2/s$ or more, preferably 30 $mm^2/s$ or more (as measured according to ASTM D445).

In another preferred embodiment herein, the kinematic viscosity at 100° C. of the API Group I mineral base oil is 8 $mm^2/s$ or more, preferably 10 $mm^2/s$ or more (according to ASTM D445).

It is preferred that the API Group II base oil has a kinematic viscosity at 100° C. of 6.0 $mm^2/s$ or more, preferably 6.5 $mm^2/s$ or more, more preferably 10 $mm^2/s$ or more (according to ASTM D445).

It is preferred that the API Group III base oil has a kinematic viscosity at 100° C. of 4 $mm^2/s$ or more, preferably 8 $mm^2/s$ or more (according to ASTM D445).

By "Group I", "Group II", "Group III", "Group IV" and "Group V" base oils in the present invention are meant lubricating oil base oils according to the definitions of American Petroleum Institute (API) for category I, II, III, IV and V. These API categories are defined in API Publication 1509, 15th Edition, Appendix E, April 2002.

A suitable Group III base oil for use herein is a Fischer-Tropsch derived base oil. Fischer-Tropsch derived base oils are known in the art. By the term "Fischer-Tropsch derived" is meant that a base oil is, or is derived from, a synthesis product of a Fischer-Tropsch process. A Fischer-Tropsch derived base oil may also be referred to as a GTL (Gas-To-Liquids) base oil. Suitable Fischer-Tropsch derived base oils that may be conveniently used as the second base oil in the lubricating composition of the present invention are those as for example disclosed in EP 0 776 959, EP 0 668 342, WO 97/21788, WO 00/15736, WO 00/14188, WO 00/14187, WO 00/14183, WO 00/14179, WO 00/08115, WO 99/41332, EP 1 029 029, WO 01/18156 and WO 01/57166.

In a preferred embodiment herein, the first base oil is a Group I mineral base oil and the second base oil is a Fischer-Tropsch derived base oil. A preferred Fischer-Tropsch derived base oil for use herein is 'GTL 8' commercially available from Shell Oil Company, GTL 8 has a kinematic viscosity at 100° C. of approximately 8 $mm^2/s$, as measured according to ASTM D445.

In addition to the first base oil and the second base oil described above, the lubricating composition may further comprise other base oil types, e.g. Group IV base oils such as poly-alpha olefins (PAOs) and Group V base oils such as dibasic acid esters, polyol esters, polyalkylene glycols (PAGs) and alkyl naphthalenes.

Poly-alpha olefin base oils (PAOs) and their manufacture are well known in the art. Preferred poly-alpha olefin base oils that may be used in the lubricating compositions of the present invention may be derived from linear $C_2$ to $C_{32}$, preferably $C_6$ to $C_{16}$, alpha olefins. Particularly preferred feedstocks for said poly-alpha olefins are 1-octene, 1-decene, 1-dodecene and 1-tetradecene.

Mixtures of the base oils mentioned herein can also be used.

The total amount of base oil incorporated in the lubricating composition of the present invention is preferably in the range of from 60 to 99 wt. %, more preferably in an amount in the range of from 70 to 98 wt. % and most preferably in an amount in the range of from 80 to 95 wt. %, with respect to the total weight of the lubricating composition.

Typically, the kinematic viscosity at 100° C. (according to ASTM D 445) of the lubricating composition is 8 cSt or greater, typically between 9.0 and 21.9 cSt, preferably above 9.3 and below 16.3 cSt.

In a preferred embodiment herein, the lubricating composition comprises an aminic antioxidant. Preferably, the aminic antioxidant is present in an amount of from 1 to 4 wt. %, preferably from 1.5 to 3.0 wt. %, based on the weight of the total lubricating composition. It has been surprisingly found that the combination of an aminic antioxidant together with the base oil, the base oil comprising a blend of a first base oil and a second base oil, provides improved oxidation stability and improved deposit control. Improved deposit control in turn provides improved engine cleanliness.

In a preferred embodiment according to the present invention, the lubricating composition comprises an aminic antioxidant having the formula below:

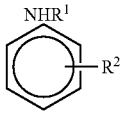

wherein $R^1$ is

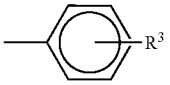

wherein $R^2$ is hydrogen, an alkyl, an aralkyl or an alkaryl group, and $R^3$ is hydrogen, an alkyl or an alkaryl group, with the proviso that when $R^2$ is hydrogen or an alkyl group with less than 8 carbon atoms, then $R^3$ is an alkyl or an alkaryl group containing at least 8 carbon atoms in the alkyl chain present in $R^3$.

In a preferred embodiment R' and $R^3$ are hydrocarbyl groups. Hence, $R^3$ is preferably an alkyl or an alkaryl group of the hydrocarbyl type.

Preferably $R^2$ is an alkyl group containing from 4 to 50 carbon atoms, preferably from 6 to 40 carbon atoms, most preferably 8 to 30 carbon atoms, with the proviso that when $R^2$ is an alkyl group with less than 8 carbon atoms, then $R^3$ is an alkyl or an alkaryl group containing at least 8 carbon atoms in the alkyl chain present in $R^3$.

Preferably $R^3$ is an alkyl group containing from 4 to 50 carbon atoms, preferably from 6 to 40 carbon atoms, most preferably 8 to 30 carbon atoms.

Suitable examples of commercially available aminic antioxidants for use herein include Infineum C9452, commercially available from Infineum UK, Irganox L57 commercially available from BASF and Vanlube SL commercially available from Vanderbilt Company Inc.

It has been found that a combination of the aminic antioxidant together with the base oil blend comprising the first base oil and the second base oil as defined hereinabove in a gas engine oil composition provides excellent deposit control and oxidation stability properties. Improved deposit control in turn leads to improved engine cleanliness properties.

The lubricating composition according to the present invention may further comprise one or more additives such as anti-oxidants, anti-wear additives, dispersants, detergents, overbased detergents, extreme pressure additives, friction modifiers, viscosity modifiers, pour point depressants, metal passivators, corrosion inhibitors, demulsifiers, anti-foam agents, seal compatibility agents and additive diluent base oils, etc.

As the person skilled in the art is familiar with the above and other additives, these are not further discussed here in detail. Specific examples of such additives are described in for example Kirk-Othmer Encyclopedia of Chemical Technology, third edition, volume 14, pages 477-526.

Anti-oxidants that may be conveniently used include phenolic antioxidants and aminic antioxidants (other than the aminic antioxidants mentioned hereinabove). Examples of suitable antioxidants are phenyl-naphthylamines and diphenylamines.

Anti-wear additives that may be conveniently used include zinc-containing compounds such as zinc dithiophosphate compounds selected from zinc dialkyl-, diaryl- and/or alkylaryl-dithiophosphates, molybdenum-containing compounds, boron-containing compounds and ashless anti-wear additives such as substituted or unsubstituted thiophosphoric acids, and salts thereof.

Examples of such molybdenum-containing compounds may conveniently include molybdenum dithiocarbamates, trinuclear molybdenum compounds, for example as described in WO 98/26030, sulphides of molybdenum and molybdenum dithiophosphate.

Boron-containing compounds that may be conveniently used include borate esters, borated fatty amines, borated epoxides, alkali metal (or mixed alkali metal or alkaline earth metal) borates and borated overbased metal salts.

The dispersant used is preferably an ashless dispersant. Suitable examples of ashless dispersants are polybutylene succinimide polyamines and Mannich base type dispersants.

The detergent used is preferably an overbased detergent or detergent mixture containing e.g. salicylate, sulphonate and/or phenate-type detergents.

Examples of viscosity modifiers which may conveniently be used in the lubricating composition of the present invention include the styrene-butadiene stellate copolymers, styrene-isoprene stellate copolymers and the polymethacrylate copolymer and ethylene-propylene copolymers. Dispersant-viscosity modifiers may be used in the lubricating composition of the present invention.

Preferably, the composition contains at least 0.1 wt. % of a pour point depressant. As an example, alkylated naphthalene and phenolic polymers, polymethacrylates, maleate/fumarate copolymer esters may be conveniently used as effective pour point depressants. Preferably not more than 0.3 wt. % of the pour point depressant is used.

Furthermore, compounds such as alkenyl succinic acid or ester moieties thereof, benzotriazole-based compounds and thiodiazole-based compounds may be conveniently used in the lubricating composition of the present invention as corrosion inhibitors.

Compounds such as polysiloxanes, dimethyl polycyclohexane and polyacrylates may be conveniently used in the lubricating composition of the present invention as defoaming agents.

Compounds which may be conveniently used in the lubricating composition of the present invention as seal fix or seal compatibility agents include, for example, commercially available aromatic esters.

The lubricating compositions of the present invention may be conveniently prepared by admixing the one or more additives with the base oil(s).

The above-mentioned additives are typically present in an amount in the range of from 0.01 to 35.0 wt. %, based on the total weight of the lubricating composition, preferably in an amount in the range of from 0.05 to 25.0 wt. %, more preferably from 1.0 to 20.0 wt. %, based on the total weight of the lubricating composition.

In another aspect, the present invention provides the use of a lubricating composition according to the present invention, in particular in a gas engine, in order to provide:

improved oxidation stability (in particular according to the IP48/97 (2004) test); and/or improved deposit control (in particular according to the PCT test or the TEOST MHT test (ASTM D7097-09)); and/or improved cleanliness (in particular according to the PCT test or the TEOST MHT test (ASTM D7097-09).

The lubricating compositions according to the present invention are useful for lubricating apparatus generally, but in particular for use as engine oils for internal combustion engines. These engine oils include passenger car engines, diesel engines, marine diesel engines, gas engines, two- and four-cycle engines, etc., and in particular gas engines.

The present invention is described below with reference to the following Examples, which are not intended to limit the scope of the present invention in any way.

EXAMPLES

Various lubricating compositions for use in a gas engine were formulated.

Tables 1 and 2 indicate the composition and properties of the fully formulated gas engine oil formulations that were tested; the amounts of the components are given in wt. %, based on the total weight of the fully formulated formulations.

All tested gas engine oil formulations were formulated as SAE 40 formulations meeting the so-called SAE J300 Specifications (as revised in May 2004; SAE stands for Society of Automotive Engineers).

All the tested gas engine oil formulations contained a combination of one or more base oils, an additive package, and, if present, an aminic antioxidant. The additive package was the same in all tested compositions.

The additive package used was either "Additive Package 1" or "Additive Package 2". Both additive packages contained a combination of additives including anti-oxidants, a zinc-based anti-wear additive, an ashless dispersant, an overbased detergent mixture, a pour point depressant and about 10 ppm of an anti-foaming agent.

"Base Oil 1" was an API Group II mineral base oil commercially available from Chevron Corporation under the trade designation "RLOP600N". Base Oil 1 has a kinematic viscosity at 100° C. (ASTM D445) of approximately 6.447 cSt ($mm^2 s^{-1}$), a kinematic viscosity at 40° C. (ASTM D445) of approximately 41.15 cSt ($mm^2 s^{-1}$), a total aromatics content (as measured according to IP368) of 0.3%, and a sulphur content of 0.004% (as measured according to ASTM D5453).

"Base Oil 2" was an API Group II mineral base oil commercially available from Chevron Corporation under the trade designation "RLOP220N". Base Oil 2 has a kinematic viscosity at 100° C. (ASTM D445) of approximately 12.04 cSt ($mm^2 s^{-1}$), a kinematic viscosity at 40° C. (ASTM D445) of approximately 103.8 cSt ($mm^2 s^{-1}$), a total aromatics content (as measured according to IP368) of 0.3%, and a sulphur content of 0.003% (as measured according to ASTM D5453).

"Base Oil 3" was an API Group I mineral base oil commercially available from Exxon Mobil under the trade designation "APE CORE SN150". Base oil 3 has a kinematic viscosity at 100° C. (ASTM D445) of approximately 5.3 cSt ($mm^2 s^{-1}$), a kinematic viscosity at 40° C. (ASTM D445) of approximately 31.7 cSt ($mm^2 s^{-1}$), a total aromatics content (as measured according to IP368) of 29.8%, and a sulphur content of 0.54% (as measured according to ASTM D5453).

"Base Oil 4" was an API Group I mineral base oil commercially available from Lukoil under the trade designation "LUKOIL PERM SN500". Base Oil 4 has a kinematic viscosity at 100° C. (ASTM D445) of approximately 10.94 cSt ($mm^2 s^{-1}$), a kinematic viscosity at 40° C. (ASTM D445) of approximately 102 cSt ($mm^2 s^{-1}$), a total aromatics content (as measured according to IP368) of 35.2%, and a sulphur content of 0.55% (as measured according to ASTM D5453).

"Base Oil 5" was an API Group I mineral base oil commercially available from Exxon Mobil under the trade designation "APE CORE SN600". Base Oil 5 has a kinematic viscosity at 100° C. (ASTM D445) of approximately 12.02 cSt ($mm^2 s^{-1}$), a kinematic viscosity at 40° C. (ASTM D445) of approximately 111.7 cSt ($mm^2 s^{-1}$), a total aromatics content (as measured according to IP368) of 41.1%, and a sulphur content of 0.73% (as measured according to ASTM D5453).

"Base Oil 6" was an API Group I Brightstock commercially available from Exxon Mobil under the trade designation APE CORE 2500 BS. Base Oil 6 has a kinematic viscosity at 100° C. (ASTM D445) of approximately 31.28 cSt ($mm_2 s^{-1}$) a kinematic viscosity at 40° C. (ASTM D445) of approximately 478.7 cSt ($mm^2 s^{-1}$) a total aromatics content (as measured according to IP368) of 56.9%, and a sulphur content of 1.05% (as measured according to ASTM D5453).

"Base Oil 7" was an API Group II base oil commercially available from Motiva under the trade designation Motiva Star 12. Base Oil 7 has a kinematic viscosity at 100° C. (ASTM D445) of approximately 12.09 cSt ($mm^2 s^{-1}$), a kinematic viscosity at 40° C. (ASTM D445) of approximately 111.4 cSt ($mm_2 s^{-1}$) a total aromatics content (as measured according to IP368) of 6.4%, and a sulphur content of 0.0016% (as measured according to ASTM D5453).

"Aminic AO" was an aminic antioxidant commercially available from Infineum UK under the trade designation Infineum C9452.

The compositions of the Examples and Comparative Examples shown in Tables 1 and 2 below were obtained by mixing the base oils with the additive package and aminic antioxidant when present using conventional lubricant blending procedures.

The compositions of the Examples and Comparative Examples as shown in Tables 1 and 2 below were subjected to a number of standard test methods in order to measure certain properties such as oxidation stability, viscosity increase, deposit control, and the like. The test methods used were as follows:

(i) Standard Test Method for determination of moderately high temperature piston deposits by themo-oxidation engine oil simulation test—the 'TEOST MHT' test (according to ASTM D7097-09);

(ii) Standard Test Method for the determination of oxidation characteristics of lubricating oil (according to 1248/97 (2004));

(iii) Panel Coker Test (PCT ISP method or 'PCT' test) for measuring piston deposits (method based on GFC Lu-29-A-15 and PSA 01563_10_00802) using the following test conditions: Test Temperature: 288° C.; Test Duration: 24 hours; Oil flow 1 ml/min; Air flow: 12 l/h; Test results used for our evaluation: Merit—total: 0 to 10 (higher is better).

The test results are shown in Tables 1 and 2 below:

TABLE 1

| | Example 1 (wt %) | Example 2 (wt %) | Example 3 (wt %) | Example 4 (wt %) | Comparative Example 1 (wt %) | Comparative Example 2 (wt %) |
|---|---|---|---|---|---|---|
| Additive Package 1 | 9.7 | 9.7 | 9.7 | 9.7 | 9.7 | 9.7 |
| Additive Package 2 | 0 | 0 | 0 | 0 | 0 | 0 |
| Base Oil 1 (Gp II) | 60 | 60 | 79.9 | 60 | 0 | 90.3 |
| Base Oil 2 (Gp II) | 0 | 0 | 0 | 0 | 0 | 0 |
| Base Oil 3 (Gp 1) | 6 | 12 | 0 | 0 | 0 | 0 |
| Base Oil 4 (Gp I) | 0 | 0 | 0 | 30.3 | 0 | 0 |
| Base Oil 5 (Gp I) | 24.3 | 10.3 | 10.4 | 0 | 90.3 | 0 |
| Base Oil 6 (Gp I) | 0 | 8 | 0 | 0 | 0 | 0 |
| Base Oil 7 (Gp II) | 0 | 0 | 0 | 0 | 0 | 0 |
| Aminic AO | 0 | 0 | 0 | 0 | 0 | 0 |
| Total | 100 | 100 | 100 | 100 | 100 | 100 |
| Viscosity at 100° C. ($mm^2/s$) | 13.1 | 13.36 | 13.74 | 13.22 | 12.24 | 13.65 |
| TBN (mgKOH/g) | 8.5 | 8.43 | 8.54 | 8.49 | 8.6 | 8.56 |
| Ash content (wt %) | 0.9 | 0.9 | 0.9 | 0.9 | 0.9 | 0.9 |
| Total Aromatics content (wt %)[1] | 11.9553 | 12.5413 | 4.5141 | 10.8456 | 37.1133 | 0.2709 |
| Sulphur content (wt %)[2] | 0.21219 | 0.22639 | 0.079116 | 0.16905 | 0.65919 | 0.003612 |
| PCT Rating[3] | 8.53 | 8.24 | 8.19 | 8.71 | 8.66 | 8 |
| IP48 Oxidation Test[4] | 78.1 | 78 | 111.2 | 72.2 | Sludge | 133 |
| IP48[4] (% 100° C. Viscosity Increase) | 41.1 | 44.7 | 55.9 | 46.1 | Sludge | 58 |
| TEOST MHT[5] [mg] at 285° C. | nm[6] | nm[6] | nm[6] | nm[6] | nm[6] | nm[6] |

[1]Total aromatics content contributed by the base oils according to IP368

[2]Sulphur content contributed by the base oils (as measured according to ASTM D5453)

[3]Panel Coker Test (PCT ISP method or 'PCT' test) for measuring piston deposits (method based on GFC Lu-29-A-15 and PSA 01563-10-00802

[4]according to IP48/97 (2004)

[5]according to ASTM D7097-09

[6]nm = not measured

TABLE 2

| | Comparative Example 3a | Example 5 (wt %) | Comparative Example 3b (wt %) | Example 6 (wt %) | Example 7 (wt %) | Example 8 (wt %) | Comparative Example 4 (wt %) |
|---|---|---|---|---|---|---|---|
| Additive Package 1 | 0 | 0 | 0 | 0 | 0 | 0 | 0 |
| Additive Package 2 | 9.1 | 9.1 | 9.1 | 8.8 | 8.8 | 8.8 | 8.8 |
| Base Oil 1 (Gp II) | 0 | 80.9 | 90.9 | 89.2 | 61.2 | 59.2 | 91.2 |
| Base Oil 2 (Gp II) | 0 | 0 | 0 | 0 | 0 | 0 | 0 |
| Base Oil 3 (Gp 1) | 0 | 0 | 0 | 0 | 0 | 0 | 0 |
| Base Oil 4 (Gp I) | 0 | 0 | 0 | 0 | 0 | 0 | 0 |
| Base Oil 5 (Gp I) | 0 | 0 | 0 | 0 | 30 | 30 | 0 |
| Base Oil 6 (Gp I) | 0 | 10 | 0 | 0 | 0 | 0 | 0 |

TABLE 2-continued

| | Comparative Example 3a | Example 5 (wt %) | Comparative Example 3b (wt %) | Example 6 (wt %) | Example 7 (wt %) | Example 8 (wt %) | Comparative Example 4 (wt %) |
|---|---|---|---|---|---|---|---|
| Base Oil 7 (Gp II) | 90.9 | 0 | 0 | 0 | 0 | 0 | 0 |
| Aminic AO | 0 | 0 | 0 | 2 | 0 | 2 | 0 |
| Total | 100 | 100 | 100 | 100 | 100 | 100 | 100 |
| Viscosity at 100° C. ($mm^2/s$) | 13.45 | 13.46 | 13.54 | 13.63 | 13.31 | 13.64 | 13.66 |
| TBN (mgKOH/g) | 5.1 | 4.8 | 5.03 | 4.4 | 4.4 | 4.31 | 4.6 |
| Ash content (wt %) | 0.56 | 0.56 | 0.56 | 0.5 | 0.5 | 0.5 | 0.5 |
| Total Aromatics Content (wt %)[1] | 5.8176 | 5.9327 | 0.2727 | 0.2676 | 12.5136 | 12.5076 | 0.2736 |
| Sulphur content (wt %)[2] | 0.0014544 | 0.108236 | 0.003636 | 0.003568 | 0.221448 | 0.221368 | 0.003648 |
| PCT Rating[3] | 7.79 | 7.84 | 2.86 | 5 | 4.8 | 8.1 | 3.03 |
| IP48 Oxidation Test[4] | sludge | 89 | 95.2 | 27.2 | 57.5 | 54.9 | 56.8 |
| IP48[4] (% 100° C. Viscosity Increase) | sludge | 38.9 | 46.7 | 15.6 | 59.3 | 76.6 | 21.3 |
| TEOST MHT[5] [mg] at 285° C. | Nm[6] | nm[5] | nm[6] | 31 | 53.1 | 21.9 | 69.5 |

[1]Total aromatics content contributed by the base oils according to IP368
[2]Sulphur content contributed by the base oils (as measured according to ASTM D5453)
[3]Panel Coker Test (PCT ISP method or 'PCT' test) for measuring piston deposits (method based on GFC Lu-29-A-15 and PSA 01563-10-00802
[4]4. according to IP48/97 (2004)
[5]5. according to ASTM D7097-09
[6]6. nm = not measured

DISCUSSION

As can be seen from the results in Tables 1 and 2, the lubricating compositions according to the present invention showed improved deposit control and improved oxidation stability properties.

As can be seen from the results in Tables 1 and 2, for those formulations containing a combination of Group I and II base oils, there is an improvement in deposit control which will therefore provide improved engine cleanliness compared to those compositions containing less than 1 wt % of aromatics contributed by the base oils.

It can also be seen from the results in Tables 1 and 2 that for those formulations containing a combination of Group I and Group II base oils, there is an improvement in oxidation stability over those compositions containing one base oil only (IP48 oxidation results).

It can also be seen from the results in Tables 1 and 2 that addition of aminic antioxidant to a lubricating formulation containing a combination of Group I and Group II base oils further improves oxidation stability and deposit control.

It can also be seen from Comparative Example 3a (containing Group II base oil only) that even if the base oil in the formulation contains some aromatics, there is an improvement in cleanliness but the oxidation stability is not improved by the use of a single base oil.

That which is claimed is:

1. A lubricating composition comprising a base oil and one or more additives, wherein the composition has:

a sulphated ash content according to ASTM D 874 of at least 0.4 wt % and at most 1.0 wt. %, by weight of the lubricating composition;

a total base number TBN value according to ASTM D 2896 of at least 4.0 mg KOH/g and at most 12 mg KOH/g;

a total aromatics content contributed by the base oil in the range from 1 wt % to 20 wt %, by weight of the lubricating composition; and a sulphur content contributed by the base oil of 0.4 wt % or less, by weight of the lubricating composition;

and wherein the base oil comprises a blend of (i) a first base oil which is an API Group I mineral base oil and (ii) a second base oil, wherein the second base oil is an API Group II base oil, wherein the API Group I mineral base oil is present at a level from 5 wt % to 40 wt %, by weight of the lubricating composition, wherein the API Group II base oil is present at a level from 50 wt % or more, by weight of the lubricating composition, wherein the lubricating composition comprises an aminic antioxidant comprising an amine formula (I):

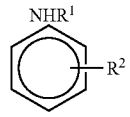

wherein $R^1$ is

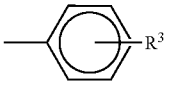

and $R^2$ is hydrogen, an alkyl, an aralkyl or an alkaryl group, $R^3$ is hydrogen, an alkyl or an alkaryl group, with the proviso that when $R^2$ is hydrogen or an alkyl group with less than 8 carbon atoms, then $R^3$ is an alkyl or alkaryl group containing at least 8 carbon atoms in the alkyl chain, and wherein the aminic antioxidant is present at a level from 1.5 to 3.0 wt %, by weight of the lubricating composition.

2. The lubricating composition according to claim 1 wherein the API Group I mineral base oil is brightstock.

3. The lubricating composition according to claim 1 wherein the viscosity of the API Group I mineral base oil is 8 $mm^2/s$ or more at 100° C.

4. The lubricating composition according to claim 1 wherein $R^2$ and $R^3$ are selected from alkyl groups having from 4 to 50 carbon atoms.

* * * * *